US006884933B2

(12) United States Patent
Akahori et al.

(10) Patent No.: US 6,884,933 B2
(45) Date of Patent: Apr. 26, 2005

(54) ELECTRONIC MUSICAL APPARATUS WITH AUTHORIZED MODIFICATION OF PROTECTED CONTENTS

(75) Inventors: Shigeki Akahori, Hamamatsu (JP); Shigenori Oguri, Hamamatsu (JP)

(73) Assignee: Yamaha Corporation, Hamamastu (JP)

( * ) Notice: Subject to any disclaimer, the term of this patent is extended or adjusted under 35 U.S.C. 154(b) by 233 days.

(21) Appl. No.: 10/385,810

(22) Filed: Mar. 11, 2003

(65) Prior Publication Data

US 2003/0177888 A1 Sep. 25, 2003

(30) Foreign Application Priority Data

Mar. 20, 2002 (JP) ..... 2002-078272

(51) Int. Cl.[7] ..... G10H 7/00; G04B 13/00; A63H 5/00

(52) U.S. Cl. ..... 84/609; 84/645; 705/51

(58) Field of Search ..... 84/609, 634, 645; 700/50–80

(56) References Cited

U.S. PATENT DOCUMENTS 5,765,152 A * 6/1998 Erickson ..... 707/9
5,848,158 A * 12/1998 Saito et al. ..... 705/54
2001/0046298 A1 * 11/2001 Terada et al. ..... 380/252
2002/0082999 A1 * 6/2002 Lee et al. ..... 705/51
2004/0210765 A1 * 10/2004 Erickson ..... 705/51

* cited by examiner

*Primary Examiner*—Jeffrey W Donels
(74) *Attorney, Agent, or Firm*—Morrison & Foerster LLP

(57) ABSTRACT

An electronic musical apparatus is designed for using original music contents kept under protection. In the apparatus, an editing section is operable to edit an original music content into a variational music content. A content judging section compares the variational music content with the original music content and judges a degree of difference therebetween to provide a judgment. A transfer control section operates based on the judgment for permitting transfer of the variational music content to an external apparatus beyond the protection. The content judging section operates when a degree of difference is sufficient to remove the protection for providing a positive judgment and operates when a degree of difference is insufficient to remove the protection for providing a negative judgment, and responds to the positive judgment for permitting transfer of the variational music content beyond the protection and responds to the negative judgment for inhibiting transfer of the variational music content within the protection.

8 Claims, 10 Drawing Sheets

FIG.3

| | | |
|---|---|---|
| TIMBRE | NO DIFFERENCE<br>TIMBRES IN SAME CATEGORY<br>TIMBRES IN DIFFERENT CATEGORY | 0<br>20<br>40 |
| PITCH | NO DIFFERENCE<br>SAME CHORD TONE<br>SAME SCALE TONE<br>OTHER TONES | 0<br>5<br>10<br>15 |
| TONE DURATION | NO DIFFERENCE<br>ONE-STEP DIFFERENCE<br>TWO-STEP DIFFERENCE OR MORE | 0<br>5<br>10 |

ELECTRONIC MUSICAL APPARATUS WITH AUTHORIZED MODIFICATION OF PROTECTED CONTENTS

BACKGROUND OF THE INVENTION

1. Industrial Field of Utilization

The present invention relates to an electronic musical apparatus having a function for limiting the use of music contents such as style data and song data loaded in the electronic musical apparatus such as an electronic musical instrument, and a program for use in the electronic musical apparatus.

2. Prior Art

In conventional electronic musical instruments, many music contents such as style data for automatic accompaniment are preloaded in ROM (Read Only Memory).

The automatic accompaniment is a function for allowing an electronic musical instrument to accomplish automatic performance of accompaniment parts only by designating chords on a keyboard. For the automatic accompaniment, various automatic accompaniment patterns suited to various kinds of music scenes such as Pops, Jazz, Latin, and dance music are prepared.

The term "style data" denotes pattern performance data on the above-mentioned accompaniment styles. Each pattern performance data consists of one or more measures or bars. The pattern performance data is read out from the memory based on a user-selected accompaniment style and is repeatedly reproduced to continue the automatic accompaniment.

For each rhythm style, pattern data on chord backing and bass tones are stored while the fundamental note of the chord is set to C, so that the read-out pattern data are converted in pitch as appropriate based on chord information or the like supplied by user's input of performance or the like. The pitch-converted pattern data are sent to a tone generator to generate a tone.

In the electronic musical instruments, many music contents such as song data for automatic performance, registration data, and timbre data for the tone generator (data for waveform synthesis) are also preloaded in ROM (Read Only Memory) in addition to the above-mentioned style data.

The registration data is data for establishing the settings of many setting operators on an operation panel by one operation in a certain kind of electronic musical instrument. In general, groups of multiple settings are prepared, so that the user selects and reads out a group of settings as appropriate while playing on the keyboard, thereby changing the settings on the operation panel in a batch operation.

The style data, song data, registration data, and timbre data stored in the ROM are loaded into a working memory, and edited according to user preferences. The edited data are stored in a flexible magnetic disk in the electronic musical instrument or transferred to a personal computer connected to the electronic musical instrument.

The user can use the above-mentioned original music contents and edited music contents obtained from the original music contents as appropriate in the "range of personal use." However, depending on the manner by which the user uses the music contents, the user may copy into the flexible magnetic disk the original music contents preloaded in the factory-shipped ROM as they are without being edited, and in some cases, the music contents may be distributed via communication networks. Electronic musical instrument makers enable users to use and edit music contents at their pleasure in the "range of personal use" in view of convenience of user's creative activities. However, since the editing function can make it easy to substantially copy the original music contents, an infringement of a copyright may occur.

This makes them impossible to protect the copyright and to provide an electronic musical instrument with excellent features of loaded music contents.

SUMMARY OF THE INVENTION

The present invention has been made to solve the above-mentioned problems. It is an object of the present invention to provide an electronic musical apparatus and a program for use in the electronic musical apparatus, which allow external use of original music contents according to the degree of change in the original music contents in view of both the user convenience and the protection of the right to the music contents.

According to the invention, an electronic musical apparatus is designed for using original music contents kept under protection. The apparatus comprises an editing section operable to edit an original music content into a variational music content, a content judging section that compares the variational music content with the original music content and judges a degree of difference therebetween to provide a judgment, and a transfer control section that operates based on the judgment for permitting transfer of the variational music content to an external apparatus beyond the protection.

Specifically, the content judging section operates when a degree of difference is sufficient to remove the protection for providing a positive judgment and operates when a degree of difference is insufficient to remove the protection for providing a negative judgment. The transfer control section responds to the positive judgment for permitting transfer of the variational music content beyond the protection and responds to the negative judgment for inhibiting transfer of the variational music content within the protection.

Thus, external use of the edited music contents is permitted only when the edited music contents are significantly or substantially different from the original music contents, Hence the original contents can be extensively used in consideration of both the user convenience and the protection of a copyright or the like of the music contents.

Preferably, the editing section edits an original music content represented by a sequence of notes each having an attribute including at least one of a timbre, a pitch and a duration, such that the variational music content is also represented by a sequence of notes having attributes different from the attributes of the notes of the original music content. For example, the editing section edits an original music content which is provided in a format based on MIDI standard. The content judging section performs a quantitative comparison between the attributes of the notes of the variational music content and the attributes of the notes of the original music content and judges a degree of difference therebetween to provide a quantitative judgment based on the quantitative comparison of the attributes. Thus, the difference in the music contents formed by the notes can be judged objectively. Further, a threshold of the degree of difference can be changed to make a judgment convincible to both the copyright holder's side and the user side.

Expediently, the inventive electronic musical apparatus further comprises a display section that visually notifies whether the content judging section has made the positive judgment or the negative judgment to the variational music content after the editing.

Thus the user can readily know the degree of difference between the original and variational music contents. If the difference between the music contents is small, data transfer is prohibited even when the user requests the transfer, and the user receives the display of the judgment result that the difference between the music contents is small, hence the user can realize that the transfer is prohibited as a result of the negative judgment on the contents. It also serves as the impetus for re-editing. On the other hand, if receiving the display of the positive judgment result that the difference between the music contents is significant, considerable, extensive or substantial, the user can use the edited music contents free from the protection.

Preferably, the inventive electronic musical apparatus further comprises a storage section that stores the variational music contents together with identification information which identifies the original music contents corresponding to the variational music contents, such that the content judging section can compare the variational music content with the corresponding original music content according to the identification information. Thus, it is easy to know a correspondence between the edited music contents and the original music contents from which the edited music contents are originated.

According to the invention, a program is provided for use in an electronic musical apparatus having a CPU and being designed for using original music contents kept under protection. The inventive program is executable by the CPU for causing the electronic musical apparatus to perform a process comprising the steps of editing an original music content into a variational music content, comparing the variational music content with the original music content and judging a degree of difference therebetween to provide a judgment, and permitting transfer of the variational music content to an external apparatus beyond the protection according to the judgment, the external apparatus being either of an external storage apparatus for storing the variational music content or an external musical apparatus for using the variational music content.

BRIEF DESCRIPTION OF THE DRAWINGS

FIG. 3 illustrates the features of a content judging section shown in FIG. 2 using a specific example.

DETAILED DESCRIPTION OF THE INVENTION

Figure 1:
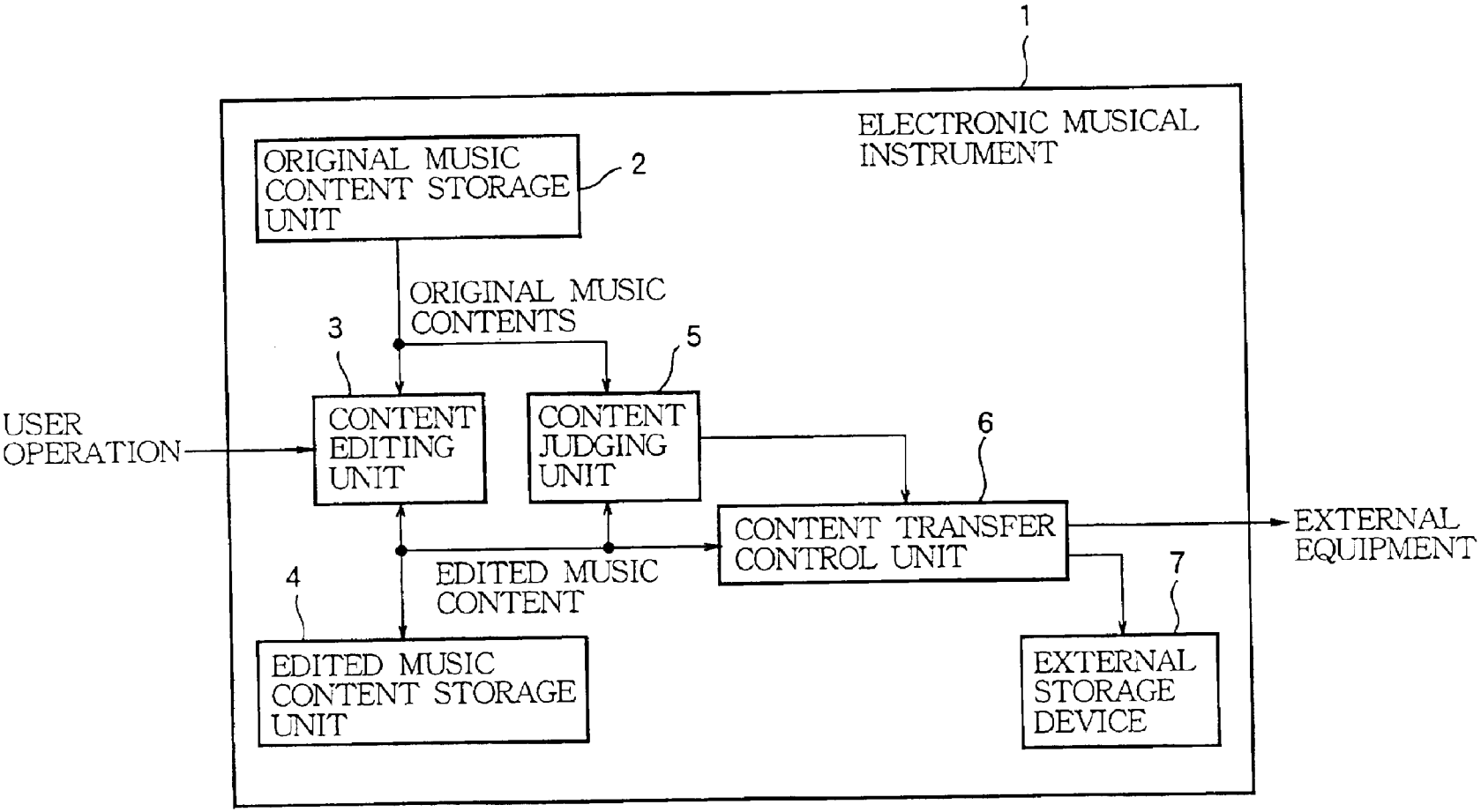
FIG. 1 is a functional block diagram for explaining a first embodiment of the invention.

FIG. 1 is a functional block diagram for explaining a first embodiment of the electronic musical apparatus according to the invention. In the figure, 1 designates an electronic musical instrument, 2 is an original music content storage section, 3 is a content editing section, 4 is an edited music content storage section, 5 is a content judging section, 6 is a content transfer control section, and 7 is an external storage device.

The electronic musical instrument 1 prestores music contents such as style data and song data in the original music content storage section 2. The content editing section 3 reads out original music contents from the original music content storage section 2 and edits the music contents.

Upon completion of editing, the edited music contents that have been changed in the editing session are stored in the edited music content storage section 4. It should be noted that there are cases where the editing session is terminated without editing the original music contents. Some time, various editing operations return the edited music contents back to the original music contents.

The content judging section 5 compares the original music content with the variational music content edited based on the original music content to judge whether the difference in the contents is equal to or bigger than a predetermined value.

Therefore, it is necessary to know the original music content from which the edited music content has been derived. To that end, when reading out the original music contents, the content editing section 3 may edit the original music contents without changing identification information for specifying the original music contents, or with adding new identification information for specifying the original music contents.

The content judging section 5 can refer to the identification information to identify the original music contents corresponding to the edited music contents.

When judging that the difference between the original and variational contents is significant, considerable, extensive or substantial, the content judging section 5 recognizes that the edited music contents are different from the original music contents. Then, the content judging section 5 permits a wider range of use beyond at least the "range of personal use" or free use as royalty free contents.

As a result, the content transfer control section 6 permits the transfer of the edited music contents stored in the edited music content storage section 4 to an external apparatus incapable of limiting the use of contents, such as the external storage device (e.g., a flexible magnetic disk FD) 7 of the electronic musical instrument or external equipment (e.g., a personal computer PC) through a communication interface.

On the other hand, when the content judging section 5 has judged that the difference between both contents is small, the content transfer control section 6 disables or prohibits the transfer of the edited music contents to the external storage device 7 and the external equipment.

The original music content storage section 2 is typically a ROM in which music contents are written by the maker beforehand. The content editing section 3 performs editing operations by copying the original music contents into a working memory, not shown, as implemented by RAM (Random Access Memory). The contents stored in the working memory are erased upon power-off. However, if the edited music content storage section 4 is a flash memory, and the edited music contents are transferred from the working memory to the edited music content storage section 4, the edited music contents can be held even upon power-off. Then, if the edited music contents stored in the edited music content storage section 4 are copied into the working memory, not shown, the editing processing can be performed again.

A display functional block may be added for displaying at least either positive the judgment result that the difference in music contents is significant, considerable, extensive or substantial, or the negative judgment result that the difference in music contents is small, according to the judgment on the difference between the original and variational contents made by the content judging section 5.

When it is judged that the transfer of the edited music contents is disabled, since it tells that the reason is the result of judgment that the difference in music contents is small, the user can discriminate the disabling from a mechanical defect in the electronic musical instrument. It also triggers the user to perform further editing operations and create edited music contents with a difference significant, considerable, extensive or substantial, enough to be transferable.

When it is judged that the edited music contents are significantly or substantially different from the original music contents, an indication that the edited music contents have been approved as a different work can also be given to the user, enabling the user to use the edited music contents with security.

Further, in addition to the judgment result, grounds for judgment including degrees of difference may be displayed in detail. Further, the display section may use various means such as visible representation on a display monitor and audible representation by synthetic voice.

Figure 2:
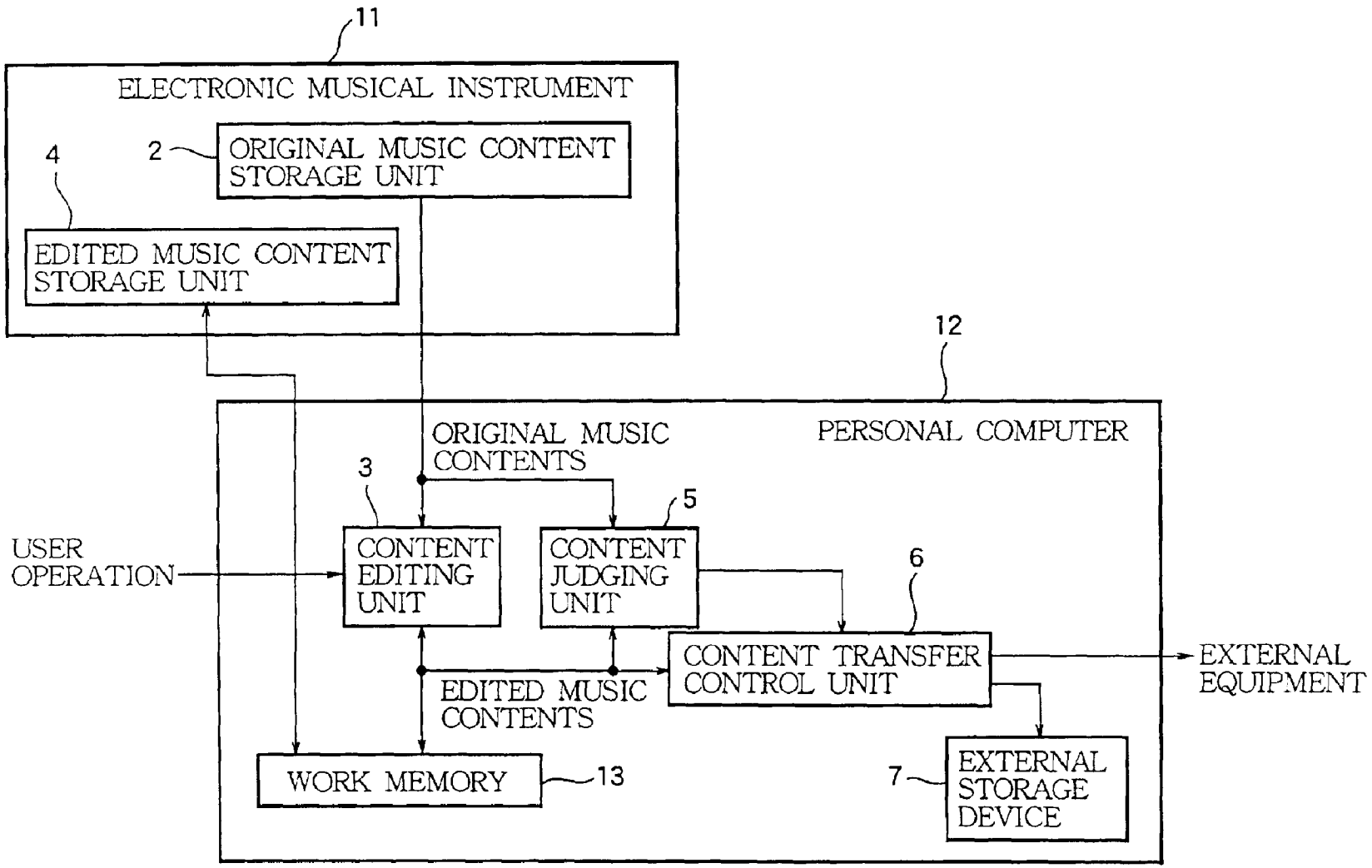
FIG. 2 is a functional block diagram for explaining a second embodiment of the invention.

FIG. 2 is a functional block diagram for explaining a second embodiment. This embodiment shows an example in which the present invention is applied to a system constructed by connecting an electronic musical instrument with a computer on which a special-purpose software program is run.

In the figure, blocks functionally common to those in the first embodiment are given the same reference numerals and the descriptions are omitted. Like the electronic musical instrument 1 shown in FIG. 1, an electronic musical instrument 11 includes the original music content storage section 2 and the edited music content storage section 4, but it is not predicted on the same structure of the electronic musical instrument 1 shown in FIG. 1.

A personal computer 12 receives from the electronic musical instrument 11 the transfer of original music contents stored in the original music content storage section 2. The content editing section 3 copies the original music contents into a working memory 13 and performs editing operations.

The transfer of the original music contents from the electronic musical instrument 11 to the personal computer 12 may be carried out in any manner, for example, by a direct connection through a cable or via a communication network such as a local area network or the Internet. If a method of transferring original music contents by performing password authentication and encrypting the original music contents is employed, the copyright of the original music contents can be protected in the transfer path.

When the content judging section 5 has judged that the difference between the edited content and the corresponding original music content is small, the content transfer control section 6 prohibits the transfer of the edited music contents stored in the working memory 13 to the external storage device 7 or the external equipment incapable of limiting the use of music contents.

In other words, even when transferred to and edited on the personal computer 12, the original music contents of the electronic musical instrument 11 is just held in the working memory 13 temporarily. On the other hand, the edited music contents are made transferable to the electronic music instrument 11 and writable into the edited music content storage section 4. Therefore, the original music contents of the electronic musical instrument 11 can be edited on the side of the personal computer 12, while the edited contents can be used on the electronic musical instrument 11.

Further, the edited music contents can be read out from the edited music content storage section 4 and reedited by the content editing section 3 on the side of the personal computer 12.

It should be noted that, if the original music contents and the edited music contents are encrypted via special-purpose software to disable external use, these contents can be written into the external storage device 7. When transferring to the external storage device 7 or the external equipment incapable of limiting the use of music contents, content transfer means has only to decode and convert the encrypted data into data usable externally before transfer.

For explaining specific examples of functions of the content judging section 5 shown in FIGS. 1 and 2, FIG. 3 shows a degree-of-difference table for converting degrees of difference in timbre, pitch, and tone duration between notes into quantitative values.

The following describes style data for automatic accompaniment. It is assumed here that the number of pattern performance data is only one, and the number of notes that form the original music content is equal to the number of notes that form the edited music content.

The content judging section 5 quantizes the degree of difference between at least some parts of the original music content and corresponding parts of the edited music content in at least one of the timbre, pitch, and tone duration of each of individual notes that form the contents to judge the degree of difference in the entire contents.

Degrees of difference in timbre are converted numerically into 0, 20, and 40, representing no difference between both contents, timbres in same category, and timbres in different categories, respectively. In this example, the timbre is specified for a piece of contents.

Degrees of difference in pitch are converted into 0, 5, 10, and 15, representing no difference between both contents, the same chord tone (tones that form the chord), the same scale tone (tones that form respective scales in the same key), and other tones, respectively.

Degrees of difference in tone duration are converted numerically into 0, 5, and 10, representing no difference between both contents, one-step difference in tone duration, and two-step difference in tone duration or more. Here, one step denotes a difference between adjacent notes in the series of whole note, half note, quarter note, eighth note, sixteenth note, etc.

As a first specific example, suppose a kind of pattern performance data for original style data indicates "quarter notes" of "do," "mi," "so," and "mi" in a C major with a timbre of "grand piano," and after edited, it becomes quarter notes of "do," "mi," "ra," and "mi" in the C major with a timbre of "electric piano." In this case, key identification may be carried out by including a key identification code in the content, or it can be estimated from a distribution of the pitches notes in the content.

The degree of difference in timbre is 20 because both belong in the same piano category. The degree of difference between the first tones is 0 because of no difference in pitch and tone duration. The degree of difference between the second tones is 0 because of no difference in pitch and tone duration. The degree of difference between the third tones is 10 because of the same scale tone in pitch with no difference in tone duration. The degree of difference between the fourth tones is 0 because of no difference in pitch and tone duration.

The degree of difference in the entire content is represented as DFD, and the degree of difference is determined as follows:

$$DFD=20+0+0+10+0=30.$$

If a predetermined degree of difference as a threshold is set to 60, since the DFD is smaller than the threshold, it is judged that the "degree of difference from the original is low." In other words, user's imagination and creativity are not so strong enough to determine that the edited one is a different work, thereby disabling external transfer.

As a second specific example, suppose a style pattern of original style data indicates "quarter notes" of "do," "mi," "so," and "mi" in a C major with a timbre of "grand piano," and after edited, it becomes "quarter notes" of "do," "re," "ra," and "fa" in the C major in a timbre of "violin."

The degree of difference in timbre is 40 because both belong in different categories. The degree of difference between the first tones is 0 because of no difference in pitch and tone duration. There is a degree of difference of 10 about the second through fourth tones because of the same scale tone in pitch with no difference in tone duration.

If the degree of difference in the entire content is represented as DFD, the degree of difference is determined as follows:

$$DFD=40+0+10+10+10=70.$$

Since the DFD is greater than the predetermined degree of 60, it is judged that "the edited one is different enough from the original." In other words, user's imagination and creativity are strong enough to determine that the edited one is a different work, thereby enabling external transfer.

As stated above, the edited contents are compared with the original music contents concerning the structure of notes and the like, and if a difference occurs to a predetermined degree or more, the edited contents are recognized as a different work, and permitted to be stored into an external memory for free use by the user beyond the copy right protection.

The above description took as an example style data as contents, but song data, timbre data (waveform data), registration data, and the like can also be applied to the protected contents the copy of which should be prohibited.

The degree of difference may be judged by changing factors as criteria of judgment according to the characteristics or attributes of each piece of contents. Since the style data or song data is data composed of notes, the degrees of difference in timbre, pitch, and tone duration of the notes are converted into numbers. If the contents to be protected is waveform data for use in a waveform memory tone generator, comparisons may be made about the differences in shape and envelop between the basic components of the waveforms.

In the case that multiple parts of pattern performance data combined into a set like style data, the degree of difference is judged for each individual part of pattern performance data. If even at least one part of pattern performance data does not meet a predetermined value for the degree of difference, the transfer of the pattern performance data is prohibited as a general rule. However, a critical number may also be set for a number of parts of pattern performance data. In this case, if the degree of difference in the parts of pattern performance data more than the critical number meets the predetermined value, the transfer is permitted.

When the style data includes multiple performance parts, comparisons are made for each part. If the degree of difference in at least one performance part does not meet the predetermined value, the transfer may be prohibited as a general rule, or otherwise permitted by setting a predetermined value for a number of performance parts in which the degree of difference meets the predetermined value.

In the above description, it is assumed that the user does not change the number and sequence of notes that form the original style data in the editing session. Therefore, the original pattern performance data and the edited pattern performance data are compared in the order of the events of the notes to determine the difference between them.

However, more sophisticated editing operations often require changes in the number or order of notes. The above-mentioned comparison based on the order of structural notes will make a significant difference incidentally only with the insertion of a different note in the beginning of the sequence. In such a case, the structure of notes is grasped as a pattern so that the original style registration pattern and the edited style registration pattern will be compared to determine the degree of correlation between both note structures.

Like the degree of difference between style data, the degree of difference between song data can be judged for each note using the degree-of-difference table as shown in FIG. 3. When the song data includes multiple performance parts such as melody, chord, bass, and rhythm parts, comparisons are made for each part. Then, if even the degree of difference in at least one performance part does not meet a predetermined value, the transfer may be prohibited as a general rule, or permitted by setting a critical value for a number of performance parts in which the degree of difference meets the predetermined value.

Further, since the song data includes a large number of notes, a comparison may be made at part of the period to judge the degree of difference.

It may also be considered that the edited song data is edited only by sorting phrases. Therefore, the degrees of correlation with the original song data needs to be calculated in sections of bars or phrases, and if more than predetermined number of bars or phrases are found actually equivalent, the transfer will be prohibited without handling both as different contents.

Figure 4:
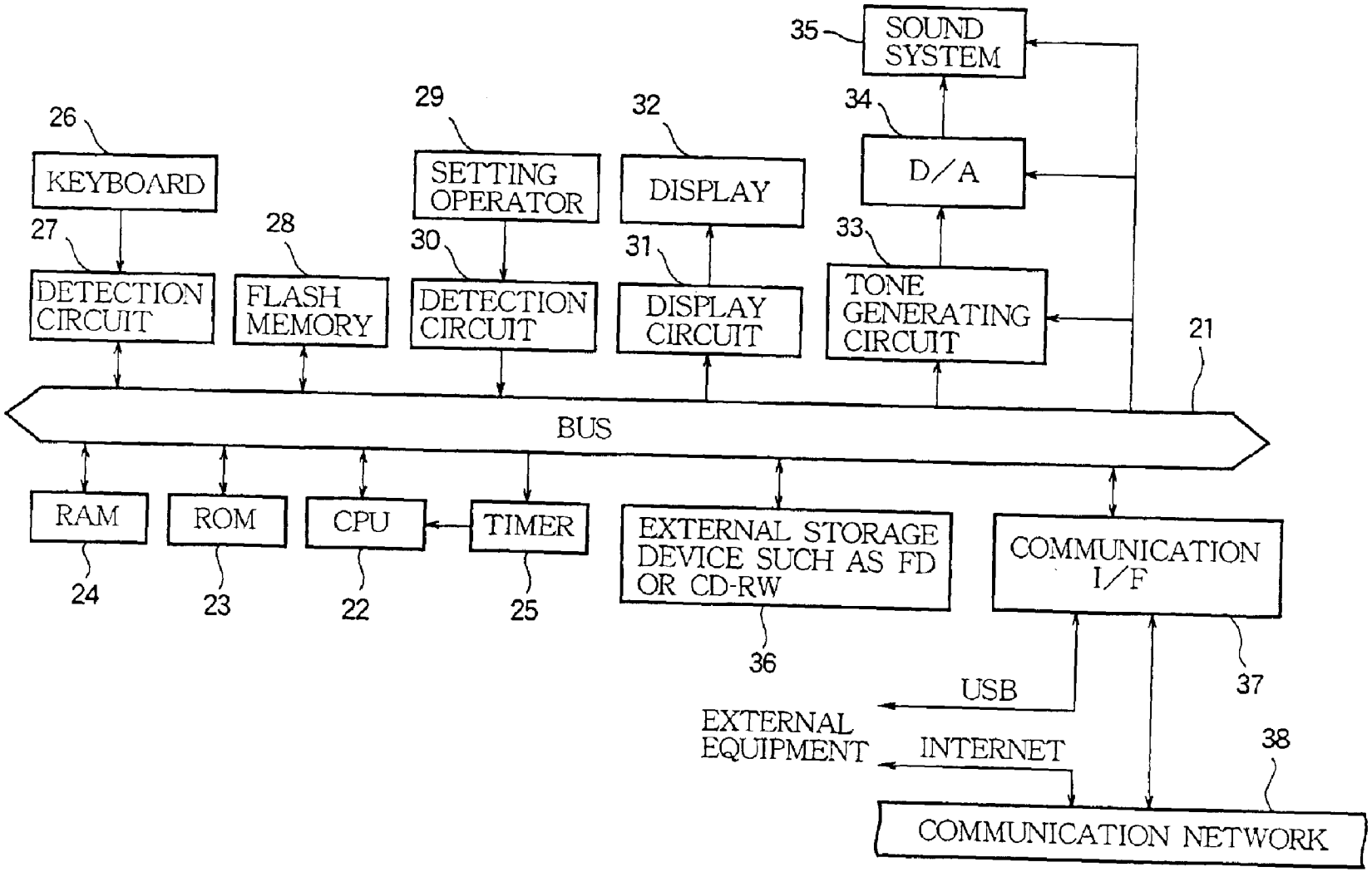
FIG. 4 is a block diagram showing an example of hardware structure for implementing one preferred embodiment of the present invention.

FIG. 4 is a block diagram of an example of hardware structure for the implementation of an embodiment according to the present invention, illustrating a case where a content usage limiting function is realized in an electronic musical instrument with a built-in CPU.

In the drawing, 21 designates a bus, 22 is a CPU (Central Processing Section), 23 is a ROM, and 24 is a RAM. 25 is a timer for measuring time, 26 is a keyboard, and 27 is a circuit for detecting operations on the keyboard. 28 is a flash memory (as an example of a rewritable ROM, but it may be an EEPROM (Electrically Erasable and Programmable ROM)) mounted on a substrate, 29 is operators including an edit switch and a transfer switch, and 30 is a detection circuit for the operators. 31 is a display circuit that controls and drives a display 32.

33 is a tone generating circuit, 34 is a D/A converter, and 35 is a sound system. An external storage device 36 stores data on a recording medium such as an FD (Flexible magnetic Disk), an optical disk like CD-RW (Compact Disc-Rewritable), or a removable semiconductor memory card. A communication interface 37 is connected to a personal computer of the user or any other electronic musical instrument, for example through a USB (Universal Serial Bus) port, or another personal computer or Internet server through a communication network 38.

The CPU 22 loads a program stored in the ROM 23 into the RAM to control all input/output operations of the electronic musical instrument and execute the function for limiting the use of original music contents as the functional structure of the present invention shown in FIG. 1.

The protection of a copyright of the original music contents may be programmed separately from the control program for control of all the operations of the electronic musical instrument and added into the control program. This program may also be downloaded into the flash memory 28 through the communication interface 37 or installed in the flash memory from a recording medium such as the FD in the external storage device.

Performance data inputted in real time from the keyboard 26 is processed in a work area of the RAM 34, and transferred to the tone generating circuit 33. Original music contents the copyright of which needs protecting such as style data for automatic accompaniment and song data for automatic performance are stored in the ROM 23. On the other hand, edited music contents are continuously held and stored in the flash memory 28 even after power-off. The style data or song data can be stored in the external storage device 36, but in such a case, the present invention does not perform copyright protection for the style data or song data.

The tone generating circuit 33 generates a tone signal according to the performance data. The tone signal is converted to an analog waveform by the converter 34, supplied to the sound system 35, and outputted from a speaker.

As shown in FIG. 2, when the copyright protection for original music pieces is realized on the personal computer, an application program stored in an HD is loaded into the RAM under the control of an operating system program to execute control of all input/output operations of the personal computer and usage limitation on the original music contents according to the present invention.

The limitation on the use of the original music contents is executed as a program incorporated into a sequencer software program with song data editing capabilities, rather than as a single application program. The program is supplied through a CD-ROM from the external storage device 36 or downloaded from a server on a communication network.

Figure 5:
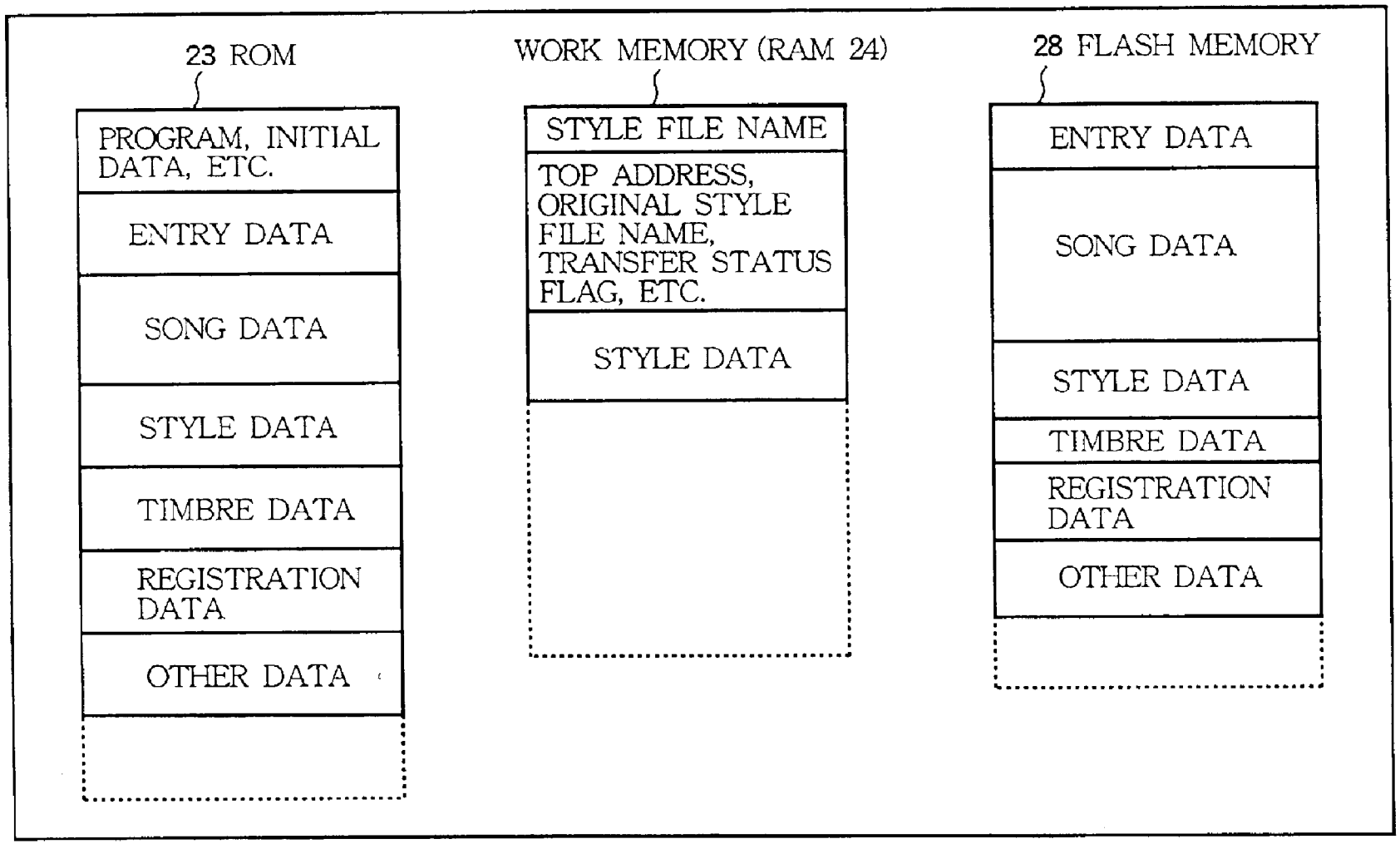
FIG. 5 illustrates a program and data stored in ROM, RAM, and a flash memory of FIG. 3.

FIG. 5 is an illustration of a program and data stored in the ROM 23, the RAM 24, and the flash memory 28.

The control program for the electronic musical instrument with the use limitation capabilities according to the present invention and initial data are stored in a memory area of the ROM 23. The ROM 23 also has an original music content memory area in which the song data, style data, timbre data, registration data, and so on are stored. Data for specifying a memory area for the file name and top address of each piece of these contents is stored as entry data.

The RAM 24 has a memory area for editing operations in addition to an area for execution of program, not shown. During editing of the style data, the name of a style file being edited, the top address of the style file, the name of an original style file loaded from the ROM 23 upon start of editing, a transfer status flag, edited style data, and so on are temporarily stored.

Upon content judgment, an original style stored in the ROM 23 may be read out and compared with the edited style data.

In the flash memory 28, the song data, the style data, the timbre data, and the registration data are stored as content files together with the entry data on each of various content files.

Figure 6:
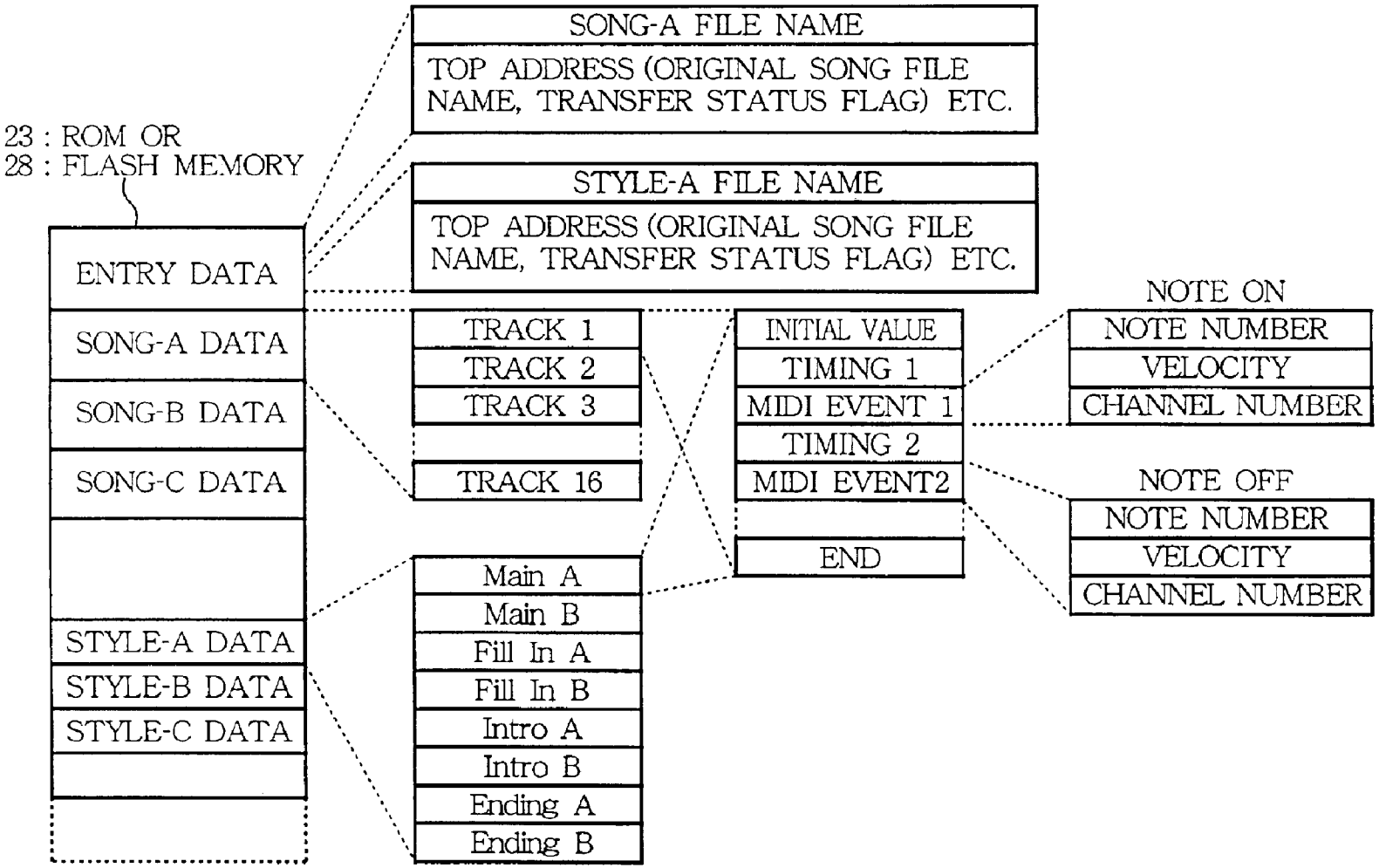
FIG. 6 illustrates a specific example of content memory areas in the ROM and the flash memory shown in FIG. 5.

FIG. 6 is an illustration of a specific example of content memory areas in the ROM 23 and the flash memory 28 shown in FIG. 5. The memory areas of both memories are basically the same as each other. In the drawing, data within parentheses are data stored in only the flash memory 28.

In the example, as shown, song data for three pieces of song A, song B, and song C, and style data for three pieces of style A, style B, and style C are stored in the ROM 23 as the song data and the style data, respectively.

The song-A data will now be described. The name of a song A file and the top address of the file are stored as the entry data. In addition to the entry data, the name of an original song file and the transfer status flag are also stored in the flash memory 28.

Upon judgment on the degree of difference between the original and edited contents, the name of the original song file is used to identify the original song file from which the edited song file is originated.

The song-A data has multiple tracks. Each track, for example following an initial data, describes sets of MIDI events 1, 2, . . . and timing data 1, 2, . . . in chronological order, and ends in end data. The initial data is information for defining a music name, tempo, time signature, key, etc. The timing data is data that indicates the time lapsed from the immediately preceding note event. For example, MIDI events of Note on, indicative of the start of a note, and Note off, indicative of the end of a note, have a note number (pitch), velocity (sound intensity), and a MIDI channel number, respectively.

Next, the style-A data will be described.

The name of a style A file and the top address of the file are stored as the entry data. In addition to the entry data, the name of an original style file and the transfer status flag are also stored in the flash memory 28.

Upon judgment on the degree of difference between the original and edited contents, the name of the original song file is used to identify the original style file from which the edited style A file is originated.

The style-A data consists of multiple pieces of pattern performance data. For variety of automatic accompaniment patterns, the style-A data in the example as shown consists of main A, main B, fill in A, fill in B, intro A, intro B, ending A, and ending B. Each pattern performance data has a length of one or more bars and can be changed with switches or the like operated by the user.

The above-mentioned pattern performance data can be described in the same format as the song data.

For the song data and the pattern performance data, various formats can be used such as those unique to sequencer software that abides by the common SMF (Standard MIDI File) or MIDI standard. Any specific format unique to each individual electronic musical instrument may be used as long as it can designate note data. Further, if gate time indicating the length of a note is added to the Note-on event, the Note-off event will be unnecessary.

The above-mentioned song data and the pattern performance data are outputted as they are even when externally outputted as files. However, they may be outputted after converted from their own unique format to the SMF format.

The operation of the present invention will be described below using flowcharts.

Figure 7:
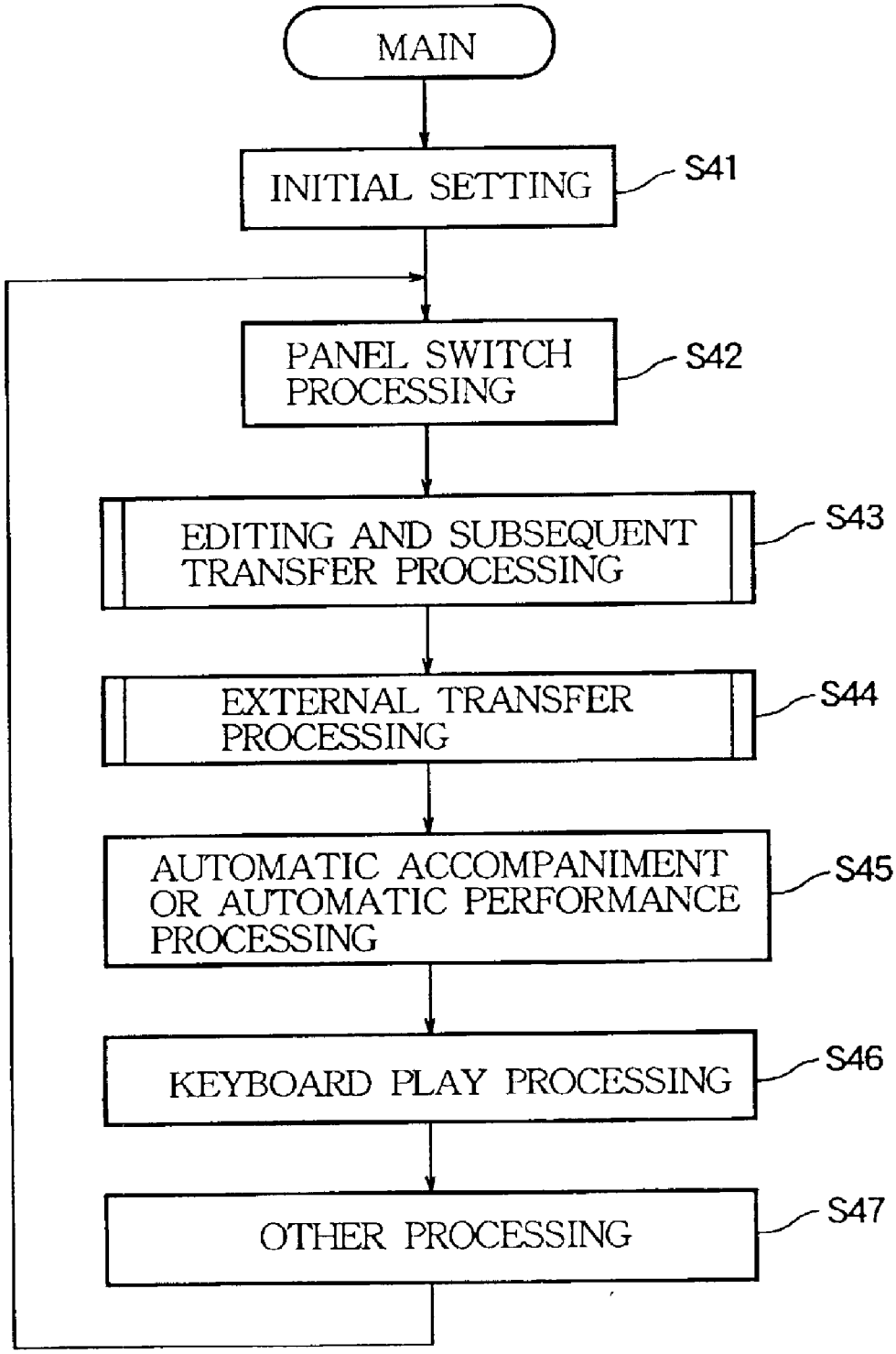
FIG. 7 is a main flowchart for explaining the operation of the first embodiment of the present invention.

FIGS. 7 to 10 are flowcharts for explaining the operation of the first embodiment shown in FIG. 1. FIG. 7 is the main flowchart.

In step S41, the electronic musical instrument is initialized. In other words, registers, flags, parameters, and the like in the working memory (RAM 24) are reset to the initial values. The MIDI interface, the communication network, the timer, and the like are then cleared to display an initial screen on the display section.

In step S42, panel switch processing is performed. The user operates panel switches to set parameter values (timbre, volume, tempo, transpose, etc.) and a mode (such as start or stop of automatic performance), and display and select various data (such as song, style, registration, and waveform data).

The selected song data and style data are transferred to the working memory (RAM 24) to enable automatic performance and automatic accompaniment, editing of the data, and storage of the edited data in the flash memory 28 with a new file name.

Further, an EDS value (0 or 1) is inverted with the flick of an edit switch. If EDS=1, editing is instructed.

On the other hand, a TRS value (0 or 1) is inverted with the flick of a transfer switch. If TRS=1, transfer to the external storage device 36 or the external equipment is instructed.

In step S43, editing processing and associated external transfer processing for edited music contents are performed. Then the processing procedure goes to step S44.

The selected style data is shown on the display in a score or list form. The user operates panel switches to edit the displayed style data by varying the timbre or changing structural notes as appropriate. Upon completion of editing, the edited one is compared with the original stored in the ROM 23, and a judgment result as to whether the comparison shows a predetermined degree of difference or more is displayed.

Then, when requested by the user, it is determined whether the edited style data is transferable before actually transferred to a flexible magnetic disk FD as the external storage device 36 or the personal computer as the external equipment. In other words, the edited style data is compared with corresponding original style data, and when the comparison shows a predetermined degree of difference or more, the transfer of the edited style data is made free and transferred. The edited style data and the like are stored in the flash memory 28. When the edited data shows such an attribute that indicates the need of copyright protection, the attribute is held.

In step S44, external transfer processing for the style data already edited is performed if requested by the user in the same manner as in step S43.

The details of steps S43 and S44 will be described later with reference to FIGS. 8 to 10.

In step S45, automatic performance processing and automatic accompaniment processing are performed. The operations are performed based on song data and/or style data preset in the ROM 23, song data and/or style data stored in the flash memory 28, and desired song data and/or style data read out from the work area of the RAM 24. When the user pushes a start SW, the data are read out sequentially, and sent to the tone generator section so that sound will be generated.

In Step S46, keyboard processing is performed. In this processing, user's keyboard operations are detected, and inputted performance data is sent to the tone generator section so that sound will be generated.

In step S47, other processing is performed. Then the processing procedure returns to step S42.

Figure 8:
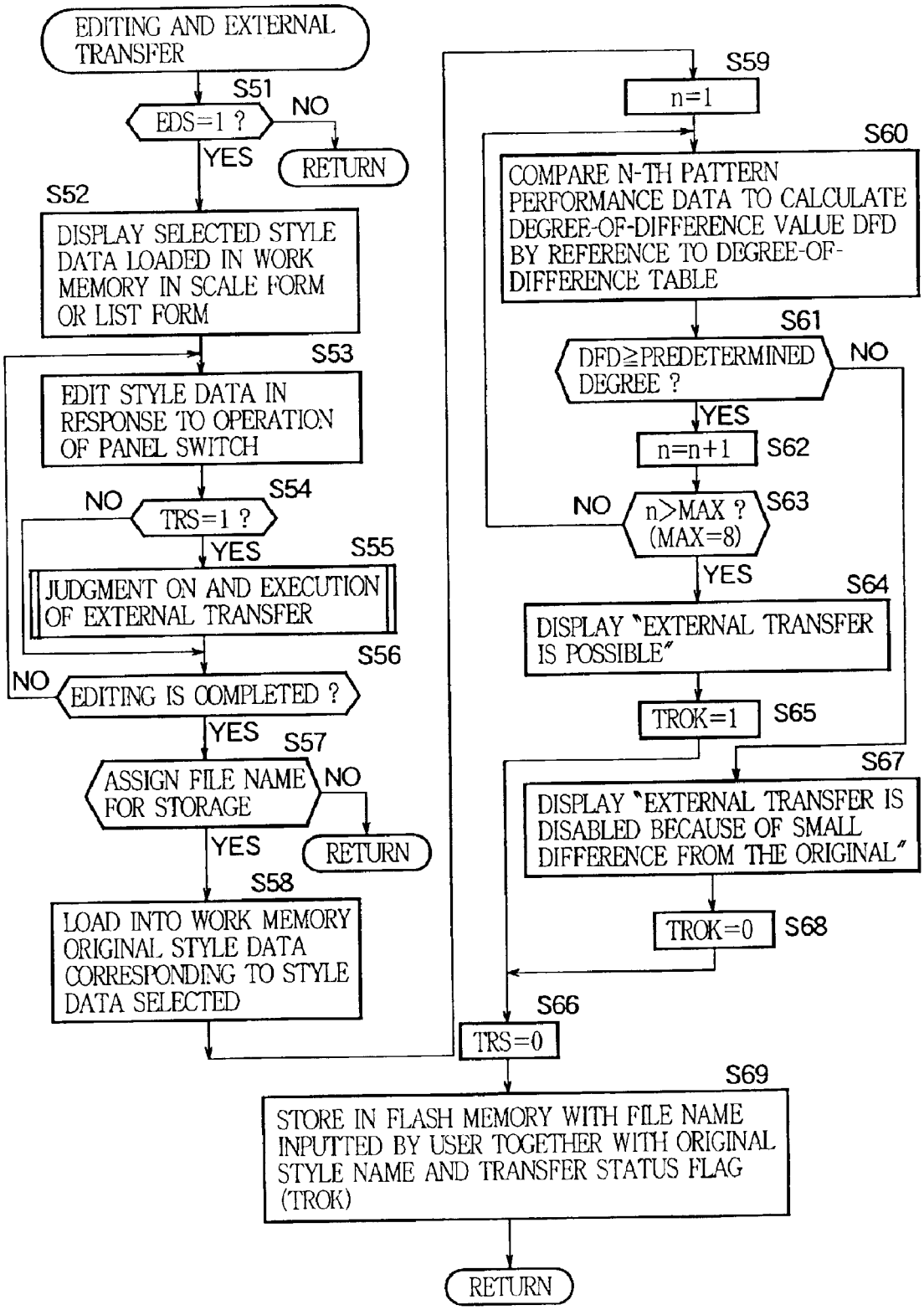
FIG. 8 is a flowchart for explaining the details of editing processing and external transfer processing for edited music contents in step S43 in the main flow shown in FIG. 7.

FIG. 8 is a flowchart for explaining the details of the editing processing and the external transfer processing in step S43 in the main flow shown in FIG. 7.

In step S51, it is judged whether the EDS as the editing instruction flag is "1" (editing instruction), that is, whether an editing instruction has been given in step S42 of FIG. 7. If EDS=1 (editing instruction), the processing procedure goes to step S52, of if not, the processing procedure returns to step S44 in the main flow shown in FIG. 7.

In Step S52, the style data on the selected working memory is shown on the display 32 in a score or list form.

In step S53, the style data is edited according to the operation of panel switches.

In step S54, it is judged whether the TRS as the transfer instruction flag is "1" (External transfer instruction), that is, whether TRS=1 in step S42 of FIG. 7. If TRS=1, the processing procedure goes to step S55, or if not, the processing procedure goes to step S56. In step S55, a judgment on external transfer is made and the external transfer is executed. The details of this step will be described later using FIG. 9.

In step S56, it is judged whether the editing session is completed. If Yes, the processing procedure goes to step S57, or if No, the processing procedure returns to step S53.

In step S57, a file name is assigned to the edited style data, and it is judged whether the edited style data is stored in the flash memory 28 of FIG. 4. If Yes, the processing procedure goes to step S58, or if No, the processing procedure returns to step S44 in the main flow shown in FIG. 7.

In step S58, the original style data corresponding to the style data being edited is read into the working memory.

In step S59, n=1 is set as an initial value of variable n.

In step S60, both of n-th pattern performance data are compared to calculate a degree-of-difference value DFD by reference to the degree-of-difference table shown in FIG. 3.

In step S61, it is judged whether the DFD is equal to or more than a predetermined degree. If Yes, the processing procedure goes to step S62, or if No, the processing procedure goes to step S67.

In step S62, the value of variable n is set to n+1.

In step S63, it is judged whether the variable n exceeds the maximum value MAX. The total number of pattern performance data is set as MAX, for example M=8. If it exceeds the maximum value MAX, the processing procedure goes to step S64, or if not exceed, the processing procedure returns to step S60.

In this flow, if all the pattern performance data in one style data show the predetermined degree of difference or more, the style data is regarded as transferable. However, this condition may be sweetened as the style data becomes transferable when a predetermined number of, for example, more than half the pattern performance data show differences from each other.

In step S64, "External transfer is possible" is displayed.

In step S65, TROK (Transfer status flag) for enabling transfer is set to "1," and the processing procedure goes to step S66.

On the other hand, if it is judged that the DFD is less than the predetermined threshold degree, "External transfer is disabled because of a small difference from the original," is shown on the display 32 in step S67. In step S68, the TROK as the transfer status flag is set to "0" (Transfer prohibition), and the processing procedure goes to step S66.

In step S66, the TRS as the transfer instruction flag is set to "0" (Absence of external transfer instruction).

In step S69, the user enters a file name to store the edited style data in the flash memory 28. At this time, the original style data name and the TROK (Transfer status flag) are stored together. Then the processing procedure returns to step S44 in the main flow shown in FIG. 7.

Figure 9:
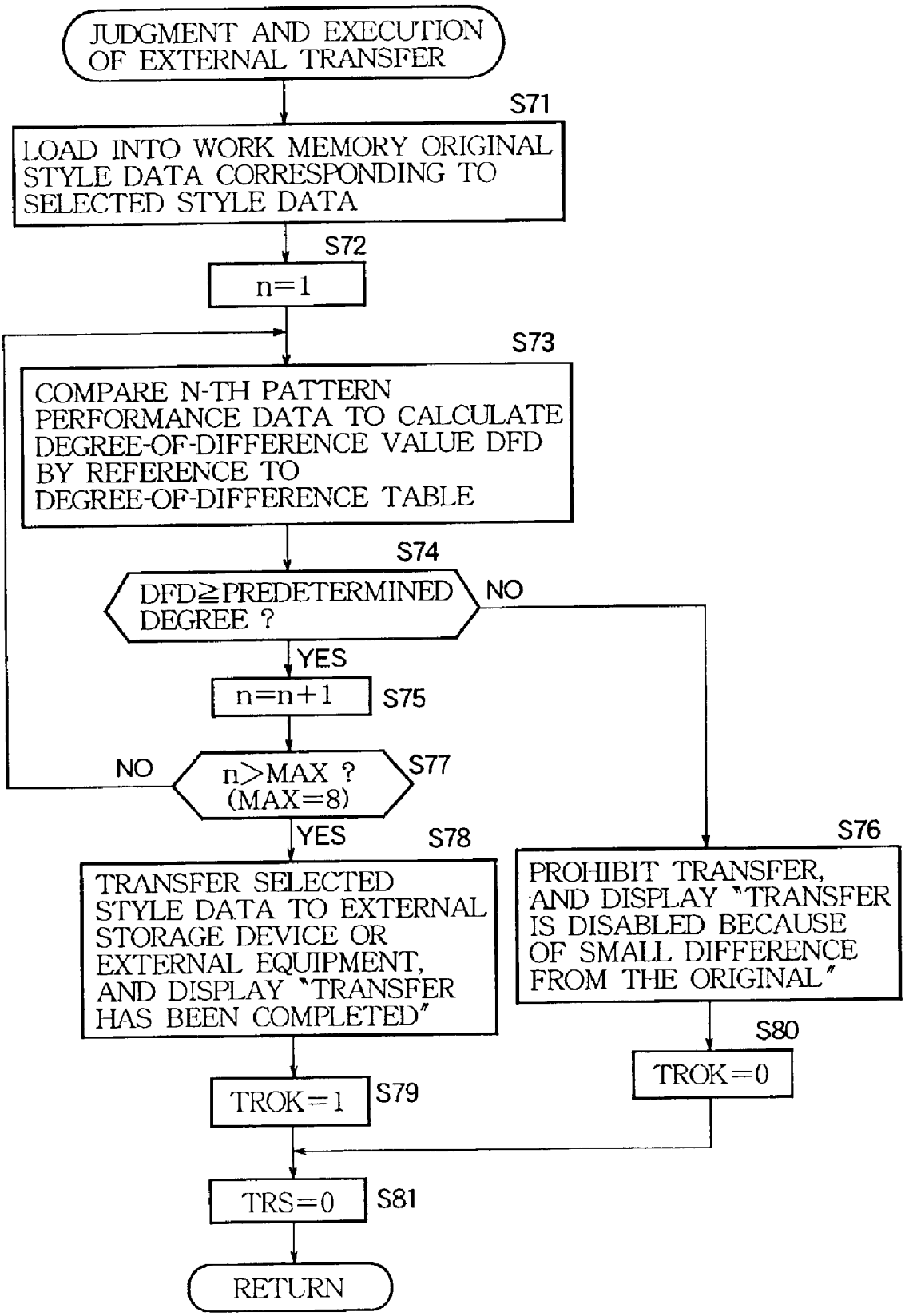
FIG. 9 is a flowchart showing the details of judgment on and execution of external transfer in step S55 of FIG. 8 and step S98 of FIG. 10.

FIG. 9 is a flowchart illustrating the details of the "judgment on and execution of external transfer" in step S55 of FIG. 8 and step S98 of FIG. 10 to be described later.

In step S71, the original style data corresponding to the style data selected is read into the working memory (RAM 24).

In step S72, the variable n is set to n=1.

In step S73, both of n-th pattern performance data of original and edited contentsare compared to calculate the degree-of-difference value DFD by reference to the degree-of-difference table shown in FIG. 3.

In step S74, it is judged whether the DFD is equal to or more than a predetermined degree. If Yes, the processing procedure goes to step S75, or if No, the processing procedure goes to step S76.

In step S75, the value of variable n is set to n+1.

In step S77, it is judged whether the variable n exceeds the maximum value MAX (the total number of pattern performance data). If it exceeds the maximum value MAX, the processing procedure goes to step S78, or if not exceed, the processing procedure returns to step S73.

In step S78, the selected style data is transferred to the flexible magnetic disk FD as the external storage device 36 or the personal computer PC as the external equipment. Further, "Transfer has been completed" is shown on the display 32.

In step S79, TROK=1 (Transfer permission) is set, and the processing procedure goes to step S81.

On the other hand, if it is judged that the DFD is less than the predetermined degree, transfer is prohibited and "External transfer is disabled because of a small difference from the original" is shown on the display 32 in step S76. In step S80, TROK=0 (Transfer prohibition) is set, and the processing procedure goes to step S81.

In step S81, the TRS is returned to TRS=0 (Absence of external transfer instruction), and the processing procedure returns to step S56 of FIG. 8.

Figure 10:
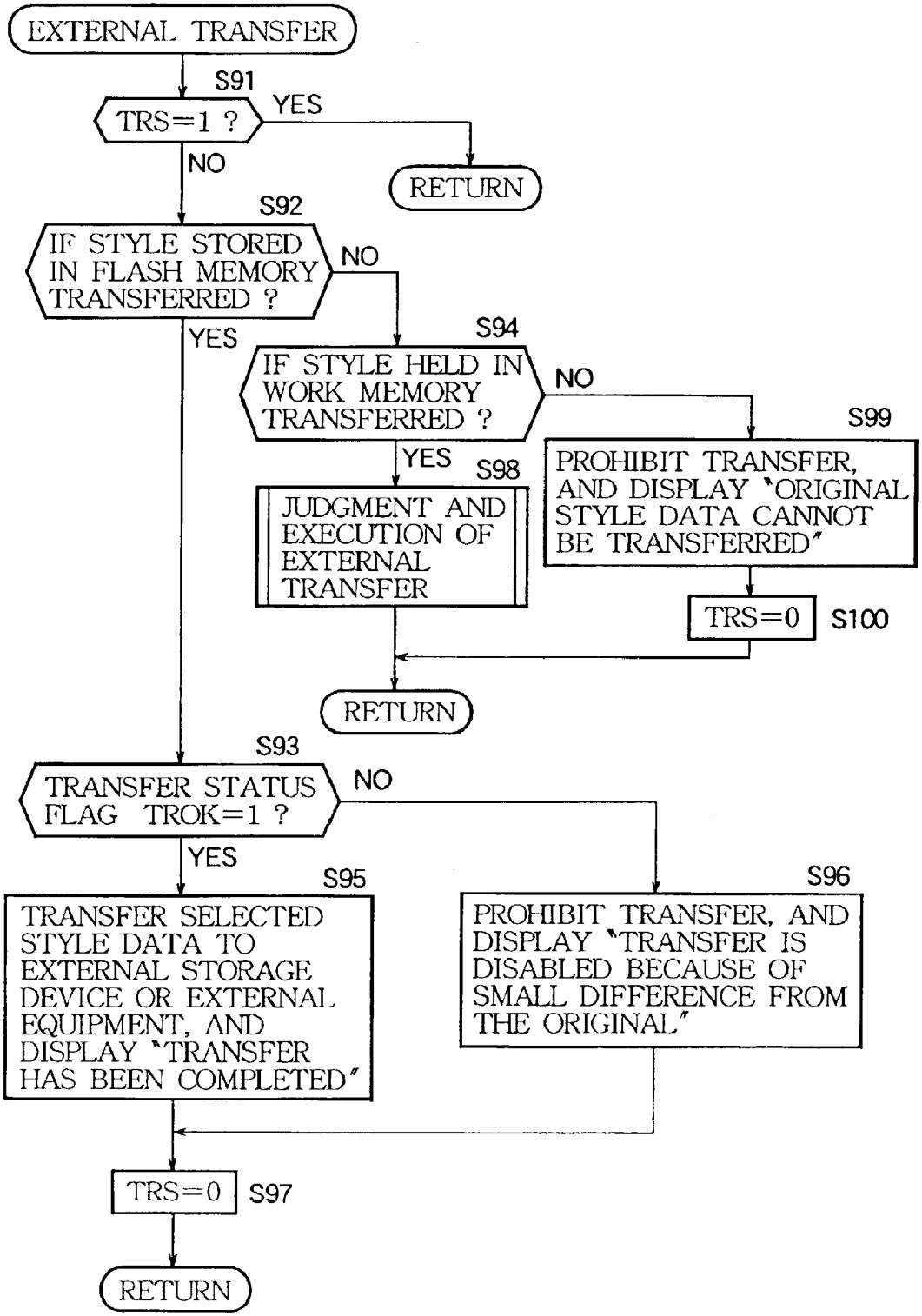
FIG. 10 is a flowchart showing the details of external transfer processing in step S44 shown in the main flow of FIG. 7.

FIG. 10 is a flowchart illustrating the details of external transfer processing step of S44 shown in the main flow of FIG. 7.

In step S91, it is judged whether TRS=1 (Presence of external transfer instruction). If Yes, the processing procedure goes to step S92, or if No, the processing procedure returns to step S45 of FIG. 7.

In step S92, it is judged whether the transfer instruction is to instruct the transfer of the style data in the flash memory 28. If Yes, the processing procedure goes to step S93, or if No, the processing procedure goes to step S94.

In step S93, it is judged whether the TROK as the transfer status flag is "1" (Transfer permission). If Yes, the processing procedure goes to step S95, or if No, the processing procedure goes to step S96.

In step S95, the selected style data is transferred to the external storage device 36 or the external equipment. Then, "Transfer has been completed" is shown on the display 32, and the processing procedure goes to step S97.

On the other hand, if TROK=0 (Transfer prohibition) in step S93, the processing procedure goes to step S96 to prohibit transfer. Then, "External transfer is disabled because of a small difference from the original" is shown on the display 32, and the processing procedure goes to step S97.

In step S97, the TRS is returned to "0" (Absence of external transfer instruction), and the processing procedure returns to step S45 in the main flow of FIG. 7.

On the other hand, if the transfer instruction is not to instruct the transfer of the style in the flash memory, it is judged in step S94 whether it is to instruct the transfer of the style in the working memory. If Yes, the processing procedure goes to step S98, or if No, the processing procedure goes to step S99.

In step S98, the processing procedure goes to the judgment on and execution of external transfer processing shown in FIG. 9. Upon completion of this processing, the processing procedure returns to the main flow shown in FIG. 7.

On the other hand, if the transfer instruction is to instruct the transfer of the original style stored in the ROM 23, the transfer is prohibited in step S99, and "The original style data is not transferable" is shown on the display 32.

In step S100, the TRS is returned to "0" (Absence of external transfer instruction), and the processing procedure returns to step S45 in the main flow of FIG. 7.

The above description took a single electronic musical instrument as a device having original music contents by way of example to describe the single electronic musical instrument and the electronic music system having the electronic musical instrument and the personal computer.

However, the device having original music contents is not limited to the electronic musical instrument. The device may be a content providing server. In other words, when orders are received from local clients as network distribution services, style data or song data on a piece of music required by each client is extracted from a database to distribute the same to a personal computer or electronic musical instrument of the client through a network.

The content using side may also be an electronic musical instrument of another user. Further, it may be a karaoke machine, a game machine, a PDA (Personal Digital Assistant) terminal, or a cellular telephone terminal. In the specification, these devices related to electronic music are regarded as electronic musical apparatuss in addition to the electronic musical instrument.

It is apparent from the above description that the present invention has the effect that can facilitate user convenience and ensure the protection of a copyright of contents.

In other words, contents obtained by making only a little change to the original music contents that are copyright protected and use limited so that little difference in sound generation will be found are not transferred to the external storage device or the external equipment, thereby protecting the copyright. The copyright protection can be performed by scrambling, inserting watermark data, or the like. The copyright protection, however, is possible without such a special method.

A threshold for defining whether the use limitation should be performed can be adjusted to make a judgment convincible to both the copyright holder side and the user side.

Even the contents edited by the user can be guaranteed as a work that differs from the original to a predetermined degree or more. Therefore, free use of the edited contents becomes possible in a range of royalty free, or in a wider range defined on the copyright holder side beyond the "range of personal use."

What is claimed is:

1. An electronic musical apparatus designed for using original music contents kept under protection, comprising:

an editing section operable to edit an original music content into a variational music content;

a content judging section that compares the variational music content with the original music content and judges a degree of difference therebetween to provide a judgment; and a transfer control section that operates based on the judgment for permitting transfer of the variational music content to an external apparatus beyond the protection.

2. The electronic musical apparatus according to claim 1, wherein the editing section edits an original music content represented by a sequence of notes each having an attribute including at least one of a timbre, a pitch and a duration, such that the variational music content is also represented by a sequence of notes having attributes different from the attributes of the notes of the original music content, and wherein the content judging section performs a quantitative comparison between the attributes of the notes of the variational music content and the attributes of the notes of the original music content and judges a degree of difference therebetween to provide a quantitative judgment based on the quantitative comparison of the attributes.

3. The electronic musical apparatus according to claim 1, wherein the content judging section operates when a degree of difference is sufficient to remove the protection for providing a positive judgment and operates when a degree of difference is insufficient to remove the protection for providing a negative judgment, and wherein the transfer control section responds to the positive judgment for permitting transfer of the variational music content beyond the protection and responds to the negative judgment for inhibiting transfer of the variational music content within the protection.

4. The electronic musical apparatus according to claim 3, further comprising a display section that visually notifies whether the content judging section has made the positive judgment or the negative judgment to the variational music content after the editing.

5. The electronic musical apparatus according to claim 1, further comprising a storage section that stores the variational music contents together with identification information which identifies the original music contents corresponding to the variational music contents, such that the content judging section can compare the variational music content with the corresponding original music content according to the identification information.

6. The electronic musical apparatus according to claim 1, wherein the editing section edits an original music content which is provided in a format based on MIDI standard.

7. The electronic musical apparatus according to claim 1, wherein the transfer control section permits transfer of the variational music content to either of an external storage apparatus for storing the variational music content or an external musical apparatus for using the variational music content.

8. A program for use in an electronic musical apparatus having a CPU and being designed for using original music contents kept under protection, the program being executable by the CPU for causing the electronic musical apparatus to perform a process comprising the steps of:

editing an original music content into a variational music content;

comparing the variational music content with the original music content and judging a degree of difference therebetween to provide a judgment; and permitting transfer of the variational music content to an external apparatus beyond the protection according to the judgment.

* * * * *